US012503876B2

(12) United States Patent
Deng

(10) Patent No.: US 12,503,876 B2
(45) Date of Patent: Dec. 23, 2025

(54) POWER OUTPUT STRUCTURE FOR SWIMMING POOL CLEANING ROBOT

(71) Applicant: Shenzhen Seauto Technology Co., Ltd., Guangdong (CN)

(72) Inventor: Zhuoming Deng, Shenzhen (CN)

(73) Assignee: Shenzhen Seauto Technology Co., Ltd., Guangdong (CN)

( * ) Notice: Subject to any disclaimer, the term of this patent is extended or adjusted under 35 U.S.C. 154(b) by 336 days.

(21) Appl. No.: 18/039,114

(22) PCT Filed: Sep. 13, 2022

(86) PCT No.: PCT/CN2022/118412
§ 371 (c)(1),
(2) Date: May 26, 2023

(87) PCT Pub. No.: WO2024/045215
PCT Pub. Date: Mar. 7, 2024

(65) Prior Publication Data

US 2024/0318451 A1 Sep. 26, 2024

(30) Foreign Application Priority Data

Sep. 2, 2022 (CN) ..... 202222335494.1

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
See application file for complete search history.

(56) References Cited

U.S. PATENT DOCUMENTS

2021/0053631 A1 † 2/2021 Chen
2023/0250664 A1 * 8/2023 Tang ..... E04H 4/1654

FOREIGN PATENT DOCUMENTS

CN 112942918 A † 6/2021

* cited by examiner
† cited by third party

*Primary Examiner* — Shay Karls
(74) *Attorney, Agent, or Firm* — ScienBiziP, P.C.

(57) ABSTRACT

The present disclosure is related to the field of swimming pool cleaning robot technology, in particular, to a power output structure for a swimming pool cleaning robot. The structure includes a main body for the swimming pool robot, with drive mechanisms on both sides. A cleaning roller is mounted on the bottom of the front end of the main body of the swimming pool robot. There is a driving device inside the main body of the swimming pool robot that drives both the drive mechanisms and the cleaning roller. This present disclosure directly drives the cleaning roller to rotate with the drive mechanism that rotates the driving wheel, thereby ensuring that the speed of the cleaning roller is several times higher than that of the driving wheel. Therefore, the swimming pool cleaning robot main body can achieve good cleaning results even when the swimming pool cleaning robot is moving slowly.

4 Claims, 5 Drawing Sheets

POWER OUTPUT STRUCTURE FOR SWIMMING POOL CLEANING ROBOT

TECHNICAL FIELD

The present disclosure relates to the technical field of swimming pool cleaning robot, particularly relates to a power output structure for a swimming pool cleaning robot.

BACKGROUND

As the development of automation, robots increasingly appear in all aspect of our daily lives. A swimming pool cleaning robot is a cleaning robot designed for the cleaning swimming pools. the swimming pool cleaning robot can repeatedly clean the pool bottom and walls and filter the water in the pool. During the working process, the swimming pool cleaning robot cleans pollutants on the pool surface by the rolling of the cleaning roller. However, existing swimming pool robots have cleaning rollers which are driven either separately or by driving wheels, which may be costly or have low cleaning efficiency due to the influence of driving speed. The present disclosure discloses a power output structure for a swimming pool cleaning robot.

SUMMARY OF INVENTION

The purpose of the present disclosure is to solve the drawbacks in existing technology by proposing a power output structure for a pool cleaning robot.

To achieve this purpose, the following technical solution is adopted: a power output structure for swimming pool cleaning robot comprising: a swimming pool robot body, both sides of the swimming pool robot body equipped with a drive mechanism; a cleaning roller installed at a bottom of a forward end of the swimming pool robot body; and a driving device provided inside the swimming pool robot body and configured to drive the drive mechanism to move forward and drive the cleaning roller to rotate and clean simultaneously, wherein, a power source for the drive mechanism and the cleaning roller comes directly from the driving device, and a transmission ratio of the driving device to the drive mechanism is greater than a transmission ratio of the driving device to the cleaning roller.

Optionally, the driving device comprises a first gear fixedly mounted on the output shaft of the motor, a fourth gear rotatably mounted on the shaft, and a third gear fixedly mounted on the cleaning roller near the end of the drive mechanism, and the first gear, the fourth gear, and the third gear are sequentially meshed.

Optionally, the drive mechanism comprises a driving wheel and a driven wheel rotatably mounted on the swimming pool robot body, and a same track is rotationally mounted on the driving wheel and the driven wheel.

Optionally, the pool cleaning robot body has a shaft, and the driving wheel is rotatably mounted on the shaft, with an inner toothed ring part on the inner side of the driving wheel. The driving device further comprises a motor fixedly mounted inside the swimming pool robot body, and a second gear is fixedly mounted on the output shaft of the motor, the second gear is fixedly connected to the first gear, and the second gear meshes with the inner toothed ring portion.

Optionally, when the driving device drives the driving wheel to rotate one circle, it simultaneously drives the cleaning roller to rotate multiple circles.

Optionally, both sides of the driving wheel and the driven wheel (3) are provided with a circular protrusion.

Compared with existing technology, the beneficial effect of this present disclosure is that:

the driving device directly drives the cleaning roller to rotate by driving the driving wheel, ensuring that the rotation speed of the cleaning roller is always several times that of the driving wheel. Therefore, the cleaning effect of the cleaning roller is not easily affected by the rotation speed of the driving wheel, ensuring that the pool cleaning robot body can have better cleaning performance even when moving slowly.

In the FIGS.: 1. Swimming pool robot body; 11. shaft; 2. Driving wheel; 21. Internal gear section; 3. Driven wheel; 4. Track; 5. Cleaning roller; 6. Driving device; 61. Motor; 62. First gear; 63. Second gear; 64. Third gear; 65. Fourth gear.

DETAILED DESCRIPTION

The present disclosure will be described in detail with reference to the accompanying drawings of the embodiments of the present disclosure. It is apparent that the embodiments described herein are only a part of the embodiments of the present disclosure, not all embodiments. Based on the embodiments of the present disclosure, all other embodiments obtained by those skilled in the art without creative labor are within the scope of protection of the present disclosure.

Figure 1:
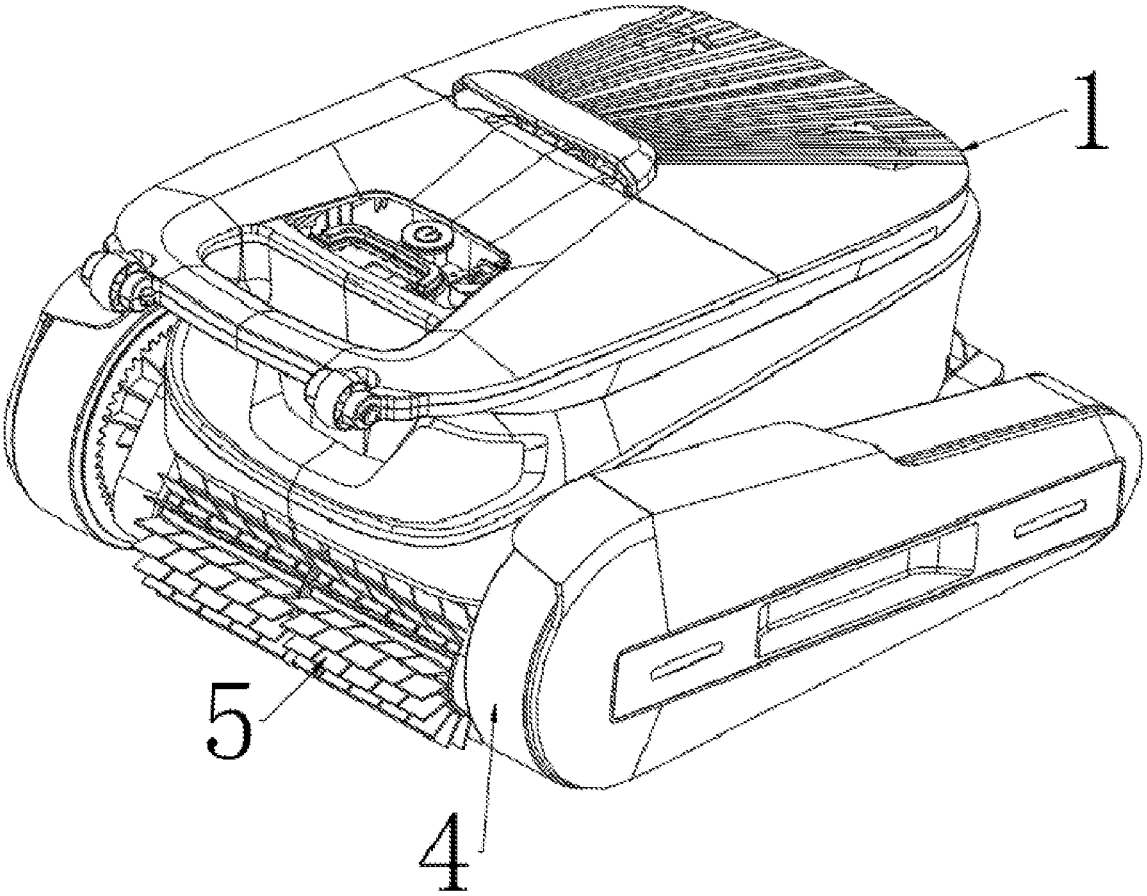
FIG. 1 is a schematic diagram of an overall structure of a swimming pool robot body according to an embodiment of the present disclosure.
Figure 2:
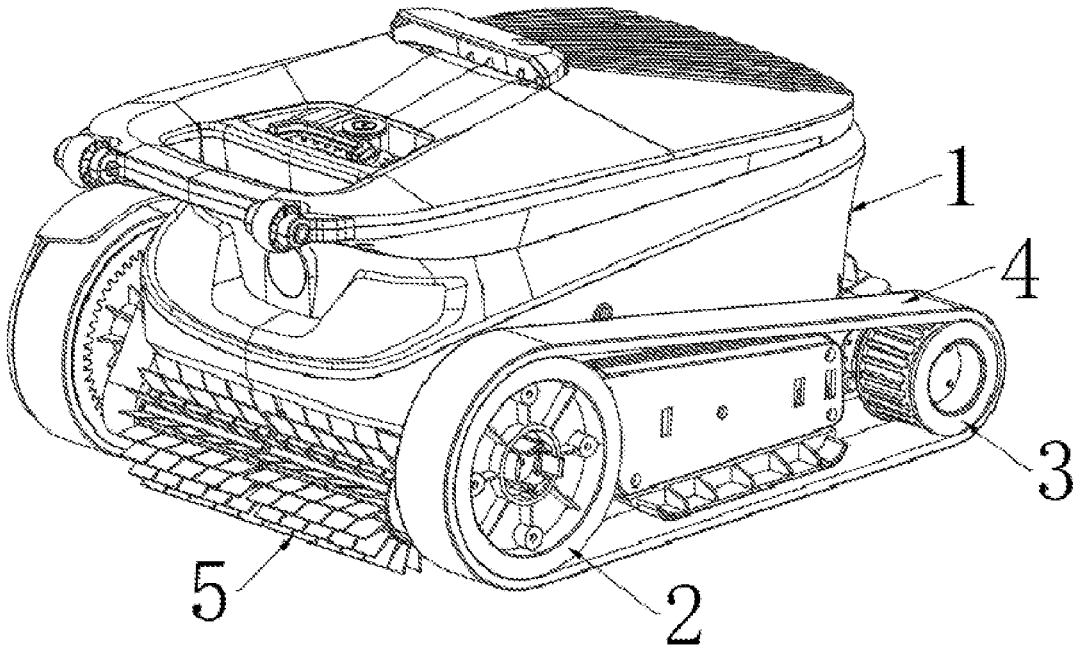
FIG. 2 is a schematic diagram of a partial structure of the swimming pool robot body in FIG. 1.
Figure 3:
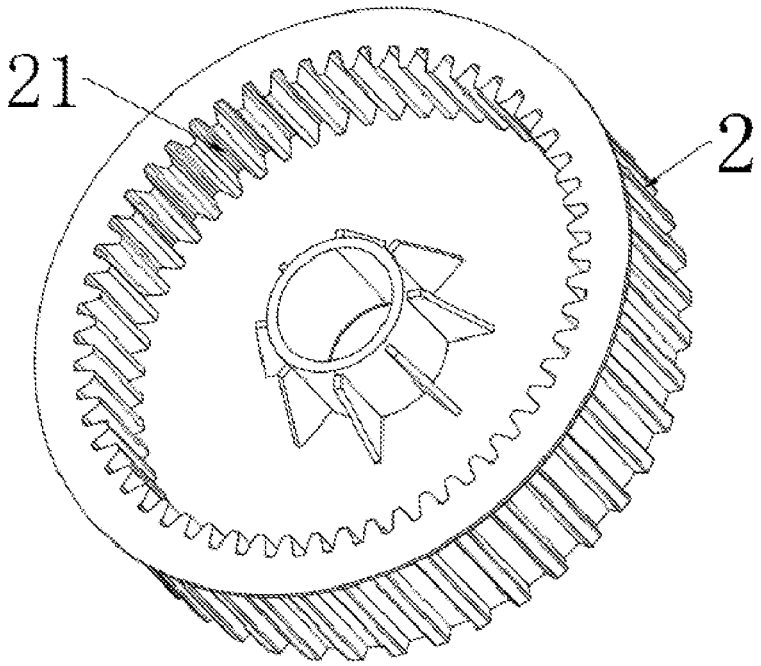
FIG. 3 is a schematic diagram of an embodiment of a driving wheel of the swimming pool robot body according to the present disclosure.
Figure 4:
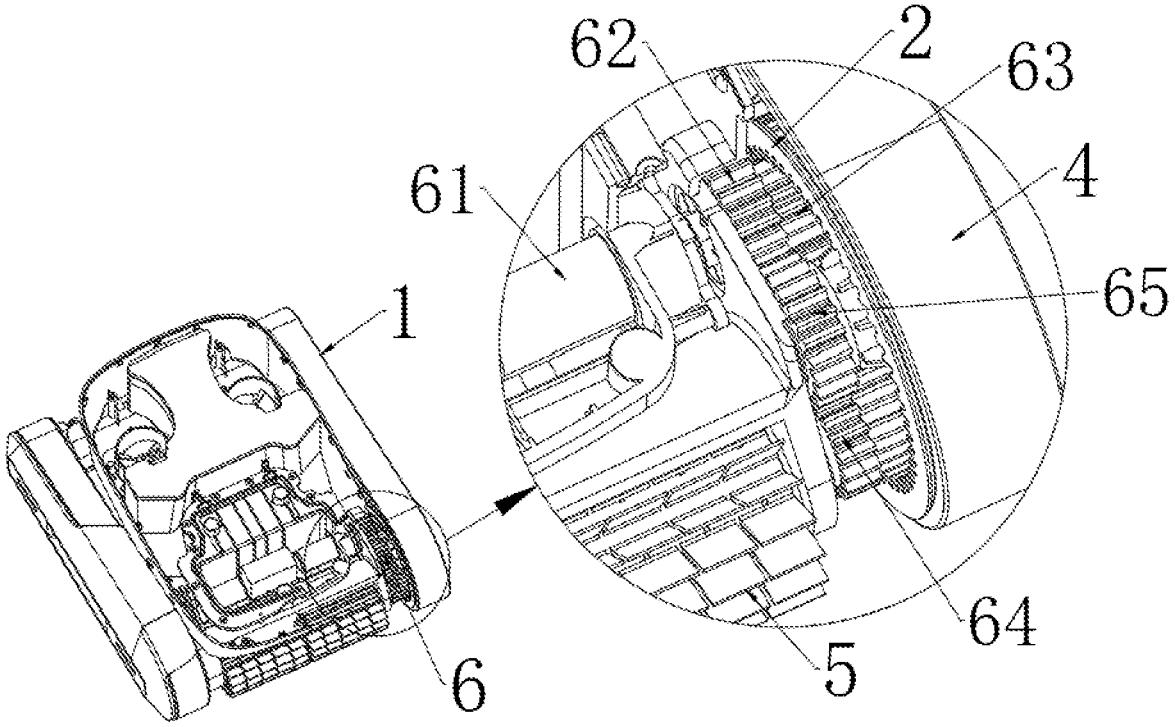
FIG. 4 is a sectional view and a partial enlarged structural diagram according to the present disclosure.
Figure 5:
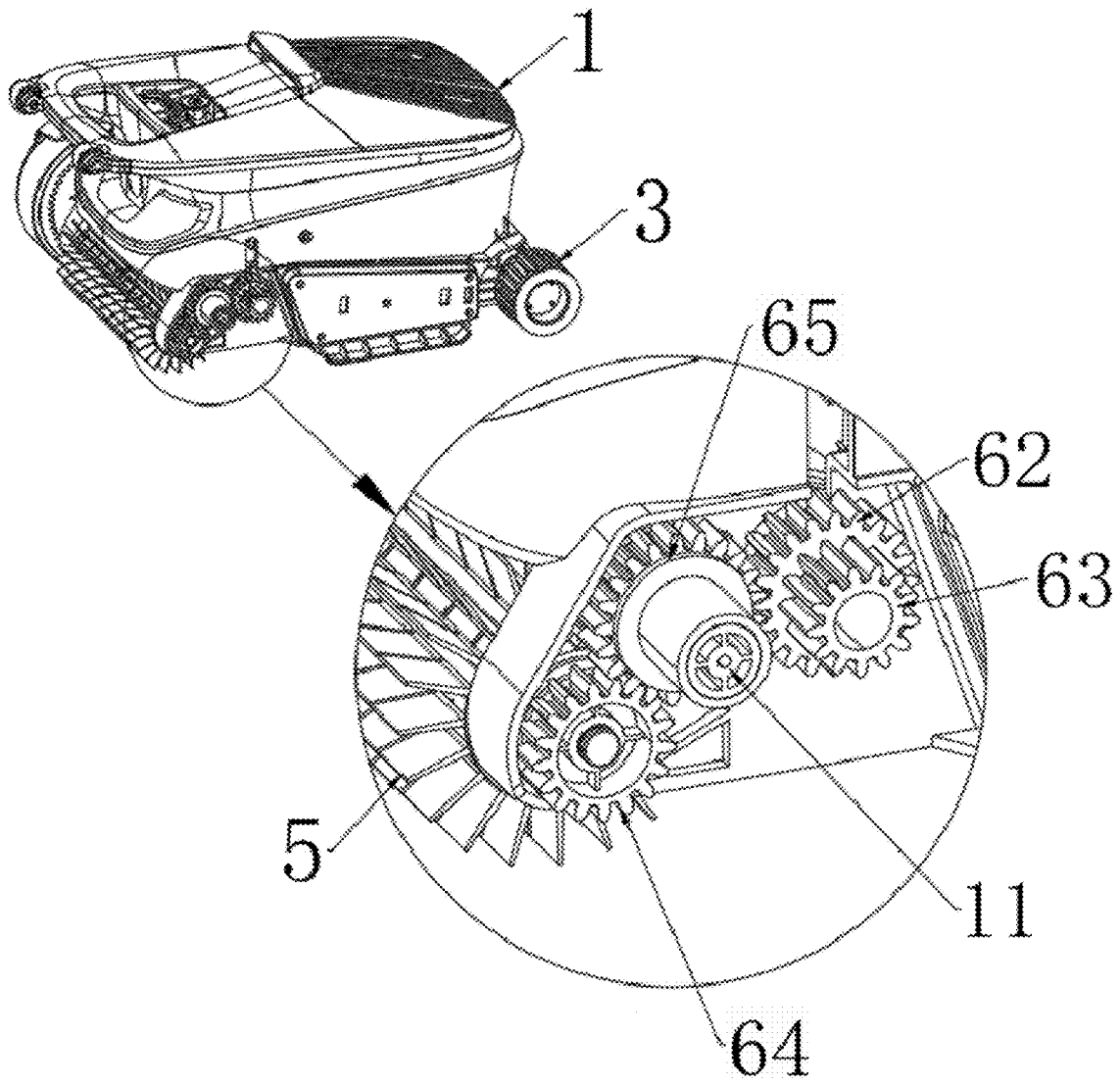
FIG. 5 is a schematic diagram of a partial structure according to the present disclosure and a locally enlarged structural diagram.

Referring to FIGS. 1-5, the present disclosure provides a technical solution. A power output structure for a swimming pool cleaning robot includes a swimming pool robot body 1, a drive mechanism is provided on two sides of the swimming pool robot body 1, a cleaning roller 5 is rotatably installed at a bottom of forward end of the swimming pool robot body 1, and a driving device 6 is provided inside the swimming pool robot body 1, and the driving device 6 is configured to simultaneously drive the drive mechanism to move forward and drive the cleaning roller 5 to rotate for cleaning. A power source for the drive mechanism and the cleaning roller 5 is come directly from the driving device 6, and a transmission ratio of the driving device 6 to the drive mechanism is greater than a transmission ratio of the driving device 6 to the cleaning roller 5.

The driving device 6 includes a first gear 62 fixedly mounted on an output shaft of a motor 61, a fourth gear 65 rotatably mounted on a shaft 11, and a third gear 64 fixedly mounted on an end near the drive mechanism of the cleaning roller 5. The first gear 62, the fourth gear 65, and the third gear 64 are sequentially meshed.

Furthermore, a rotation speed of the cleaning roller 5 is close to a rotation speed of the motor 61 through a transmission of the first gear 62, the fourth gear 65, and the third gear 64. Therefore, when the driving wheel 2 rotates one revolution, the cleaning roller 5 rotates multiple revolutions. The high-speed rotating cleaning roller 5 improves the cleaning performance of the swimming pool cleaning robot.

The drive mechanism includes a driving wheel 2 and a driven wheel 3 rotatably mounted on the swimming pool robot body 1, a same track 4 is rotationally mounted on the driving wheel 2 and the driven wheel 3.

The driving wheel 2 is rotatably mounted on a shaft 11 provided on the swimming pool robot body 1, and an internal gear portion 21 is provided on an inner side of the driving wheel 2. The driving device 6 further includes the motor 61 fixedly mounted inside the swimming pool robot body 1, a second gear 63 is fixedly mounted on the output shaft of the motor 61, and the second gear 63 is fixedly connected to the first gear 62. The second gear 63 meshes with the internal gear portion 21.

Furthermore, the motor 61 needs to drive the second gear 63 to rotate several times before driving the driving wheel 2 to rotate one revolution through the internal gear portion 21. Therefore, it can not only reduce a speed of the driving wheel 2 and make the driving wheel 2 travel slowly, but also increase a torque during the transmission of the driving wheel 2, which the driving wheel 2 accessible to more areas.

When the driving device 6 drives the driving wheel 2 to rotate one revolution, the cleaning roller 5 is simultaneously driven to rotate multiple revolutions.

Furthermore, when the driving device 6 drives the driving wheel 2 to rotate one circle, it will simultaneously drive the cleaning roller 5 to rotate multiple circles.

Both sides of the driving wheel 2 and the driven wheel 3 are equipped with annular protrusions.

In addition, the annular protrusions on both sides of the driving wheel 2 and the driven wheel 3 can limit a position of a track 4 installed on the driving wheel 2 and the driven wheel 3, thereby avoiding the track 4 from falling off the driving wheel 2 and the driven wheel 3 during rotation.

The working principle is as follows. When in use, by starting the motor 61 to rotate, the motor 61 drives the second gear 63 to rotate, causing the driving wheel 2 to rotate. The rotation of the driving wheel 2 will drive the track 4 to rotate, thus achieving the driving of the swimming pool robot main body 1. At the same time, when the motor 61 rotates, the first gear 62 will drive the fourth gear 65 to rotate, the fourth gear 65 will then drive the third gear 64 to rotate, and the third gear 64 will then drive the cleaning roller 5 to rotate and make it sweep and clean the swimming pool.

The above description is only the preferred embodiment of the present disclosure. However, the scope of protection of the present disclosure is not limited to this. Any person skilled in the art familiar with the technical field of the present disclosure, within the technical scope disclosed by the present disclosure, should be covered within the scope of protection of the disclosure by equivalent replacement or modification based on the technical solution and the present disclosure concept of the present disclosure.

What is claimed is:

1. A power output structure for swimming pool cleaning robot comprising:

a swimming pool robot body (1), a drive mechanism attached to each side of the swimming pool robot body (1);

a cleaning roller (5) installed at a bottom of a forward end of the swimming pool robot body (1); and a driving device (6) provided inside the swimming pool robot body (1) and configured to drive the drive mechanism to move forward and drive the cleaning roller (5) to rotate and clean simultaneously, wherein, the driving device provides power directly to the drive mechanism and the cleaning roller (5), and a transmission ratio of the driving device (6) to the drive mechanism is greater than a transmission ratio of the driving device (6) to the cleaning roller (5);

wherein:

the drive device (6) is in internal meshing engagement with the drive mechanism;

the drive mechanism comprises a driving wheel (2), rotatably mounted on the swimming pool robot body (1);

the swimming pool robot body (1) comprises a shaft (11), the driving wheel (2) is rotatably mounted on the shaft (11), an inner side of the driving wheel (2) is provided with an inner toothed ring portion (21); and the driving device (6) comprises a motor (61) fixedly mounted inside the swimming pool robot body (1); a first gear (62) fixedly mounted on an output shaft of the motor (61) and configured to drive the cleaning roller (5); a second gear (63) fixedly mounted coaxially to an end face of the first gear (62) and meshes with the inner toothed ring portion (21).

2. The power output structure for swimming pool cleaning robot according to claim 1, the driving device (6) further comprising a fourth gear (65) rotatably mounted on the shaft (11) of the swimming pool body; and a third gear (64) fixedly mounted on the cleaning roller (5) near the end of the drive mechanism, wherein the first gear (62), the fourth gear (65), and the third gear (64) are sequentially meshed.

3. The power output structure for swimming pool cleaning robot according to claim 2, the drive mechanism further comprising a driven wheel (3) rotatably mounted on the swimming pool robot body (1); and a track (4) rotationally mounted on the driving wheel (2) and the driven wheel (3).

4. The power output structure of the swimming pool cleaning robot according to claim 3, wherein: when the driving device (6) drives the driving wheel (2) to rotate one circle, the driving device simultaneously drives the cleaning roller (5) to rotate multiple circles.

* * * * *